US010927714B2

(12) United States Patent
Erickson

(10) Patent No.: US 10,927,714 B2
(45) Date of Patent: Feb. 23, 2021

(54) VALVE TRAIN WITH SWITCHABLE ENGINE BRAKING

(71) Applicant: Deere & Company, Moline, IL (US)

(72) Inventor: Neil Erickson, Denver, IA (US)

(73) Assignee: DEERE & COMPANY, Moline, IL (US)

( * ) Notice: Subject to any disclaimer, the term of this patent is extended or adjusted under 35 U.S.C. 154(b) by 20 days.

(21) Appl. No.: 16/220,937

(22) Filed: Dec. 14, 2018

(65) Prior Publication Data

US 2020/0191022 A1 Jun. 18, 2020

(51) Int. Cl.
*F01L 1/18* (2006.01)
*F01L 1/255* (2006.01)

(52) U.S. Cl.
CPC ..... *F01L 1/181* (2013.01); *F01L 1/255* (2013.01); *F01L 2305/00* (2020.05); *F01L 2800/06* (2013.01)

(58) Field of Classification Search
CPC . F01L 1/181; F01L 1/255; F01L 1/185; F01L 1/08; F01L 2800/06; F01L 13/065; F01L 2001/0537; F01L 2001/186; F01L 2305/00
USPC ..... 123/90.16, 90.39, 90.44
See application file for complete search history.

(56) References Cited

U.S. PATENT DOCUMENTS

| | | | | |
|---|---|---|---|---|
| 6,584,954 B2 * | 7/2003 | Janak | F02B 29/00 123/321 |
| 7,278,384 B2 | 10/2007 | Fernandez et al. | |
| 7,934,477 B2 * | 5/2011 | Elnick | F01L 1/18 123/90.16 |
| 8,479,694 B2 | 7/2013 | Manther et al. | |

FOREIGN PATENT DOCUMENTS

| | | | | |
|---|---|---|---|---|
| DE | 102015213627 B3 | 11/2016 | | |
| DE | 102016212480 A1 | 1/2018 | | |
| EP | 2495408 A2 | 9/2012 | | |
| GB | 2546078 A | 7/2017 | | |
| WO | 2017012614 A1 | 1/2017 | | |
| WO | WO-2017060496 A1 * | 4/2017 | | F01L 1/18 |
| WO | WO2017060496 A1 | 4/2017 | | |

OTHER PUBLICATIONS

European Search Report issued in counterpart application No. 19213831.1 dated Apr. 20, 2020.

* cited by examiner

*Primary Examiner* — Zelalem Eshete
(74) *Attorney, Agent, or Firm* — Michael Best & Friedrich LLP

(57) ABSTRACT

An internal combustion engine defining at least one cylinder, the internal combustion engine including a first camshaft lobe, a second camshaft lobe, a valve in fluid communication with the at least one cylinder, a pivot, and a follower in contact with and operatively engages the pivot, the valve, the first camshaft lobe, and the second camshaft lobe. During use, the follower is operable in a first mode, in which the follower is configured to transmit motion between the first camshaft lobe and the valve, and a second mode, in which the follower is configured to transmit motion between the first camshaft lobe and the valve and the second camshaft lobe and the valve.

23 Claims, 8 Drawing Sheets

70
74
78
82
Piston Position
TPC
BDC

244
First Camshaft Lobe
Cam Lift
104

240
Second Camshaft Lobe
Cam Lift
112

126
open
closed
Exhaust Valve
Valve Position
122 time

VALVE TRAIN WITH SWITCHABLE ENGINE BRAKING

FIELD

The present disclosure relates to a rocker arm for use with an internal combustion engine (ICE) and more specifically to a rocker arm able to selectively convey inputs from two or more camshaft lobes to an engine valve.

BACKGROUND

Internal combustion engines can be retrofit to include compression release engine braking capabilities or "jake brakes." To do so, engines adjust valve timing to compress air within the cylinders and produce a braking force.

SUMMARY

In one aspect, an internal combustion engine defining at least one cylinder, the internal combustion engine including a first camshaft lobe, a second camshaft lobe, a valve in fluid communication with the at least one cylinder, a pivot, and a follower in contact with and operatively engaging the pivot, the valve, the first camshaft lobe, and the second camshaft lobe, wherein the follower is operable in a first mode, in which the follower is configured to transmit motion between the first camshaft lobe and the valve, and a second mode, in which the follower is configured to transmit motion between the first camshaft lobe and the valve and the second camshaft lobe and the valve.

In another aspect, an internal combustion engine defining at least one cylinder, the internal combustion engine including a first camshaft lobe sized and shaped to produce positive power, a second camshaft lobe sized and shaped to produce negative power, a valve in fluid communication with the at least one cylinder, a pivot, and a follower. The following includes a body including a first end in contact with the pivot, a second end opposite the first end in contact with the valve, and a first contact surface in contact with the first camshaft lobe, and a subframe movably coupled to the body and including a second contact surface in contact with the second camshaft lobe, wherein the follower is operable in a positive power mode, in which the subframe is movable relative to the body, and in a negative power mode, in which the subframe is fixed relative to the body.

In another aspect, a valve train assembly for use with an engine having a valve and a pivot, the valve train assembly including a camshaft having a first camshaft lobe sized and shaped to produce positive power and a second camshaft lobe sized and shaped to produce negative power, a follower having a body including a first end in contact with the pivot, a second end opposite the first end in contact with the valve, and a first contact surface in contact with the first camshaft lobe, and a subframe movably coupled to the body and including a second contact surface in contact with the second camshaft lobe, wherein the follower is operable in a positive power mode, in which the subframe is movable relative to the body, and in a negative power mode, in which the subframe is fixed relative to the body.

In another aspect, a follower for use with an engine having a valve, a pivot, a first camshaft lobe sized and shaped to produce positive power, and a second camshaft lobe sized and shaped to produce negative power, the follower including a body in contact with and operatively engaging the pivot, the valve, the first camshaft lobe, and the second camshaft lobe, wherein the follower is operable in a first mode, in which the follower is configured to transmit motion between the first camshaft lobe and the valve, and a second mode, in which the follower is configured to transmit motion between the second camshaft lobe and the valve.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of the formation and arrangement of components set forth in the following description or illustrated in the accompanying drawings. The disclosure is capable of supporting other implementations and of being practiced or of being carried out in various ways.

Figure 1:
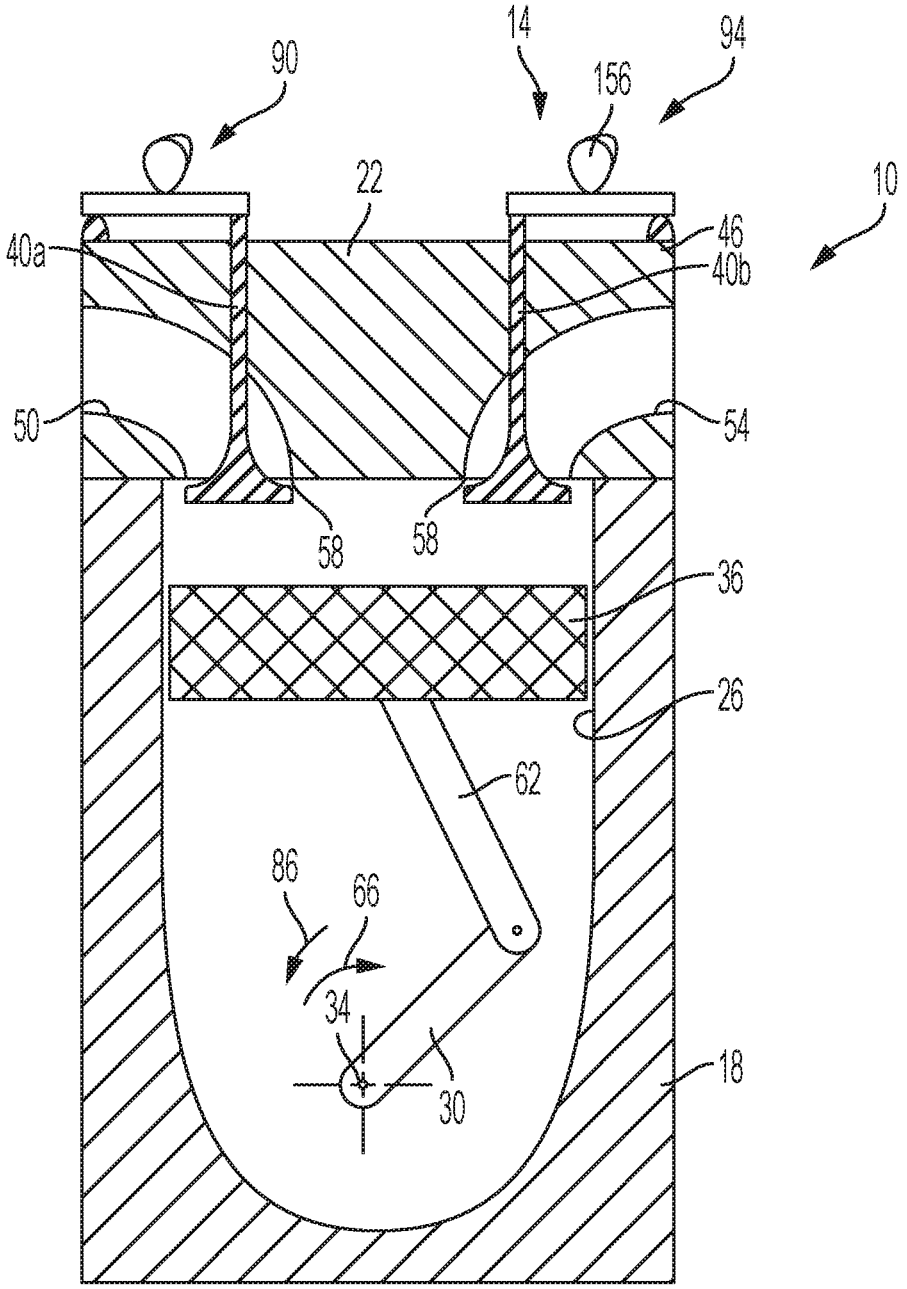
FIG. 1 is a section view of an internal combustion engine with an improved valve train mounted thereon.

FIG. 1 illustrates an internal combustion engine (ICE) 10 with an improved valve train 14 installed thereon. The ICE 10 includes a block 18, a cylinder head 22 coupled to the block 18 to at least partially enclose a cylinder 26 defined by the block 18, and a crank shaft 30 rotatably coupled to the block 18 for rotation about a crank axis 34. The improved valve train 14 is configured to selectively open and close a plurality of valves 40*a*, 40*b* in communication with the cylinder 26.

As shown in FIG. 1, the cylinder head 22 of the ICE 10 includes a body 46. The body 46 defines an intake runner 50 extending between and in fluid communication with an intake manifold (not shown) and the cylinder 26, and an exhaust runner 54 extending between and in fluid communication with an exhaust manifold (not shown) and the cylinder 26. Each runner 50, 54 also includes a seat 58 positioned adjacent the cylinder 26 and configured to interact with a corresponding valve 40*a*, 40*b*. In the illustrated implementation, each runner 50, 54 has a single aperture open to the cylinder 26 (e.g., accommodates a single valve); however in alternative implementations, more apertures may be present to accommodate additional valves (e.g., in a four valve head configurations, and the like). In still other implementations, more than one intake or exhaust runner may exist to convey gasses between the intake manifold and the cylinder and the exhaust manifold and the cylinder, respectively.

The ICE 10 also includes a piston 36 and a connecting rod 62 as is well known in the art (see FIG. 1). During use, the piston 36 is positioned and reciprocally travels within the cylinder 26 between a top dead center (TDC) positioned proximate the cylinder head 22 and a bottom dead center (BDC) position away from the cylinder head 22. As is well known in the art, the reciprocating motion of the piston 36 within the cylinder 26 rotates the crank shaft 30 about the crank axis 34 in a first direction of rotation 66 (see FIG. 1). In the illustrated implementation, the ICE 10 is a four-stroke design having a conventional intake stroke, compression stroke, expansion or power stroke, and exhaust stroke.

During operation, the ICE 10 is operable in a positive power condition, in which the ICE 10 drives the crank shaft 30 in the first direction of rotation 66 (e.g., applies torque to the crank shaft 30 in the first direction 66), and a negative power condition, in which the ICE 10 resists the rotation of the crank shaft 30 and acts as a brake (e.g., applies torque to the crank shaft 30 in a second direction 86 opposite the first direction 66). Stated differently, the positive power condition of the ICE 10 generally corresponds with combustion cycle operations while the negative power condition generally corresponds with compression release engine braking operations.

As shown in FIG. 1, the valve train 14 of the ICE 10 includes an intake assembly 90 configured to control the flow of gasses between the cylinder 26 and the intake runner 50, and an exhaust/brake assembly (EBA) 94 configured to control the flow of gasses between the cylinder 26 and the exhaust runner 54. For the purposes of this application, only the EBA 94 will be described in detail herein.

Figure 2:
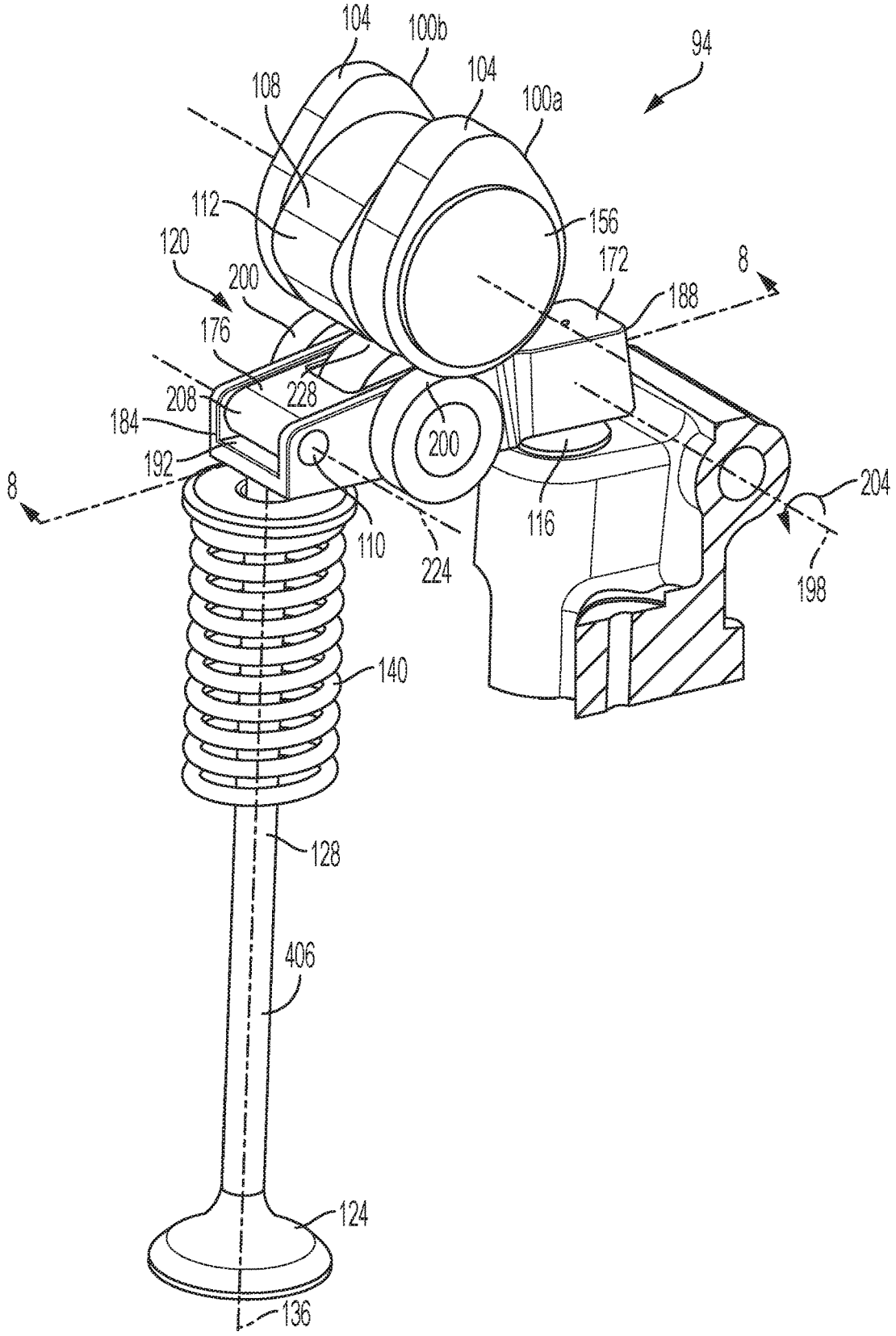
FIG. 2 is a perspective view of an exhaust assembly of the valve train of FIG. 1.
Figure 3:
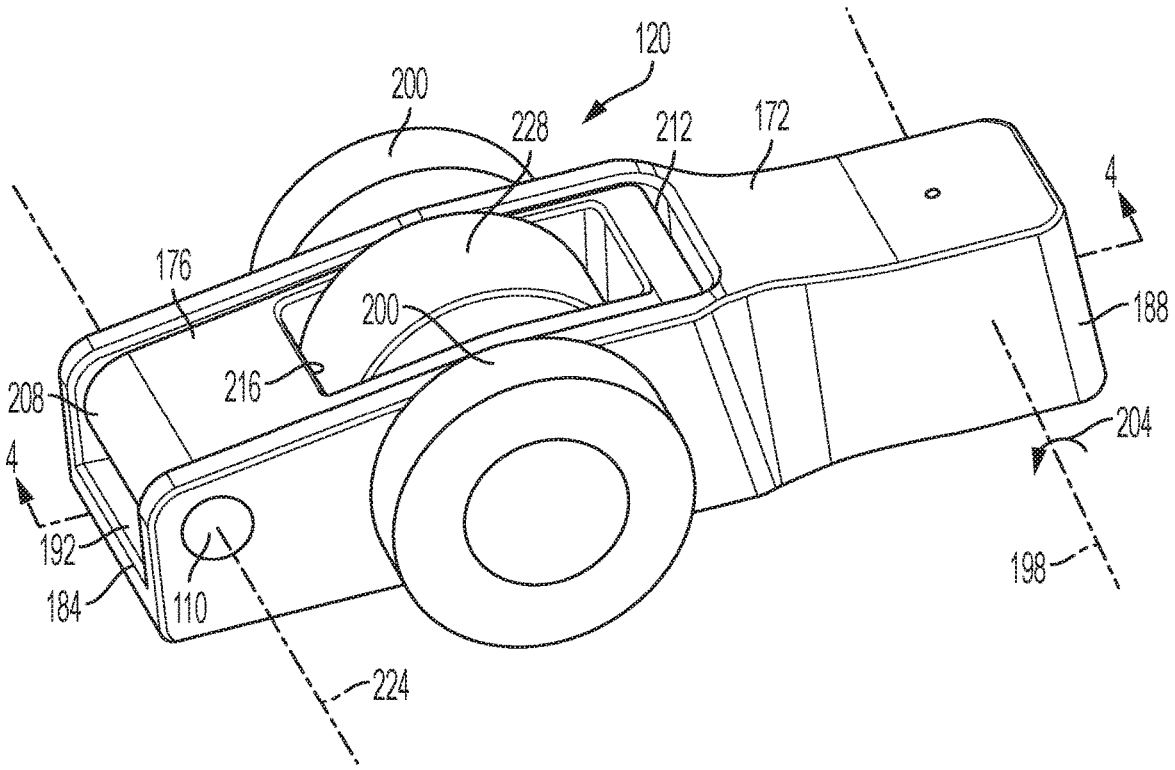
FIG. 3 is a perspective view of a rocker arm assembly of the exhaust assembly of FIG. 2.

Referring to FIG. 2, the EBA 94 of the valve train 14 includes the exhaust valve 40*b* selectively engageable with the valve seat 58 of the exhaust runner 54, a first camshaft lobe 100*a*, 100*b* having a first lift profile 104, a second camshaft lobe 108 having a second lift profile 112 different than the first lift profile 104, a pivot 116 supported by the cylinder head 22, and a rocker arm assembly 120 (also referred to as a follower). In the illustrated implementation, the EBA 94 forms a Type II valve train assembly. However, in alternative implementations, the capabilities described herein may be applied to alternative styles of valve train assemblies including, but not limited to, Type I, Type III, Type IV, and Type V.

As shown in FIGS. 2, and 6-8, the pivot 116 is movably supported by the cylinder head 22 and acts as a lash adjuster. However, in alternative implementations, the pivot 116 may be fixed relative to the cylinder head 22 or mounted to other elements of the ICE 10 (e.g., the block 18, and the like). Furthermore, while the illustrated pivot 116 includes a domed element (see FIG. 6), in alternative implementations the pivot 116 may include a rocker shaft and the like.

The exhaust valve 40*b* of the EBA 94 includes a head 124 configured to selectively engage the seat 58 of the exhaust runner 54, and a stem 128 extending from the head 124 to a distal end 132. The stem 128 defines a valve axis 136 extending therethrough. During operation, the exhaust valve 40*b* is movably mounted to the cylinder head 22 for movement with respect thereto along the valve axis 136. More specifically, the exhaust valve 40*b* is movable relative to the cylinder head 22 between a closed position, in which the head 124 of the valve 40*b* engages and forms a seal with the seat 58 of the exhaust runner 54 (e.g., to fluidly isolate the cylinder 26 from the exhaust runner 54), and an open position, in which the head 124 of the valve 40*b* does not engage the seat 58 (e.g., allowing gasses to flow between the cylinder 26 and the exhaust runner 54). An exhaust valve spring 140 is coupled to the valve 40*b* and configured to bias the valve 40*b* toward the closed position.

While the illustrated EBA 94 includes a single exhaust valve 40*b*, it is understood that in alternative implementations more than one exhaust valve 40*b* may be present (e.g., in four-valve cylinder heads).

The first camshaft lobe 100*a*, 100*b* and the second camshaft lobe 108 are both integrally formed on a first camshaft 156. The first camshaft 156, in turn, is rotatably mounted to the cylinder head 22 and driven by the crank shaft 30 (e.g., via a timing chain, a timing belt, a timing gear, and the like).

In the illustrated implementation, the first camshaft lobe 100*a*, 100*b* is formed as a pair of lobe portions 100*a*, 100*b*, each having the same first lift profile and being positioned on either side of the second camshaft lobe 108. In alternative implementations, the first camshaft lobe 100*a*, 100*b* may be a single lobe. In still other alternative implementations, the first and second camshaft lobes 100*a*, 100*b*, 108 may be located on separate cam shafts (not shown). In such implementations, the timing of the first and second camshaft lobes 100*a*, 100*b*, 108 may be adjusted independently.

The first lift profile 104 of the first camshaft lobe 100*a*, 100*b* is configured to produce positive power during operation of the ICE 10 (e.g., the first lift profile 104 accommodates the combustion cycle operations). The second lift profile 112 of the second camshaft lobe 108 is different than the first lift profile 104 and is configured to produce negative power during operation of the ICE 10 (e.g., the second lift profile 112 accommodates compression release engine braking operations).

As shown in FIGS. 2-8, the rocker arm assembly 120 is in operable communication with the pivot 116, the distal end 132 of the exhaust valve 40*b*, the first camshaft lobe 100*a*, 100*b*, and the second camshaft lobe 108. During operation of the ICE 10, the rocker arm assembly 120 is configured to selectively transmit inputs from the two camshaft lobes 100*a*, 100*b*, 108 to the exhaust valve 40*b*, causing the valve 40*b* to move between the open and closed positons. More specifically, the rocker arm assembly 120 is operable in a first mode 122, in which the rocker arm assembly 120 transmits the inputs of the first camshaft lobe 100 to the exhaust valve 40*b* and does not transmit the inputs of the second camshaft lobe 108 to the exhaust valve 40*b* (see FIG. 9), and a second mode 126, in which the rocker arm assembly 120 transmits the inputs of the first camshaft lobe 100*a*, 100*b* to the exhaust valve 40*b* and the inputs of the second camshaft lobe 108 to the exhaust valve 40*b* (see FIG. 9). Although not shown, the rocker arm assembly 120 may also include a third mode, in which the rocker arm assembly 120 transmits the inputs from the second camshaft lobe 108 to the exhaust valve 40*b* but does not transmit the inputs from the first camshaft lobe 100*a*, 100*b* to the exhaust valve 40*b*.

The rocker arm assembly 120 includes a body 172, a subframe 176 movable with respect to the body 172, and a locking mechanism 180 extending between and operatively engaging both the body 172 and the subframe 176. The body 172 of the rocker arm assembly 120 is substantially elongated in shape having a first end 184 configured to interact with the distal end 132 of the exhaust valve 40*b*, and a second end 188, opposite the first end 184, configured to interact with the pivot 116. The body 172 also at least partially defines a recess 192 sized to receive at least a portion of the subframe 176 therein.

Figure 6:
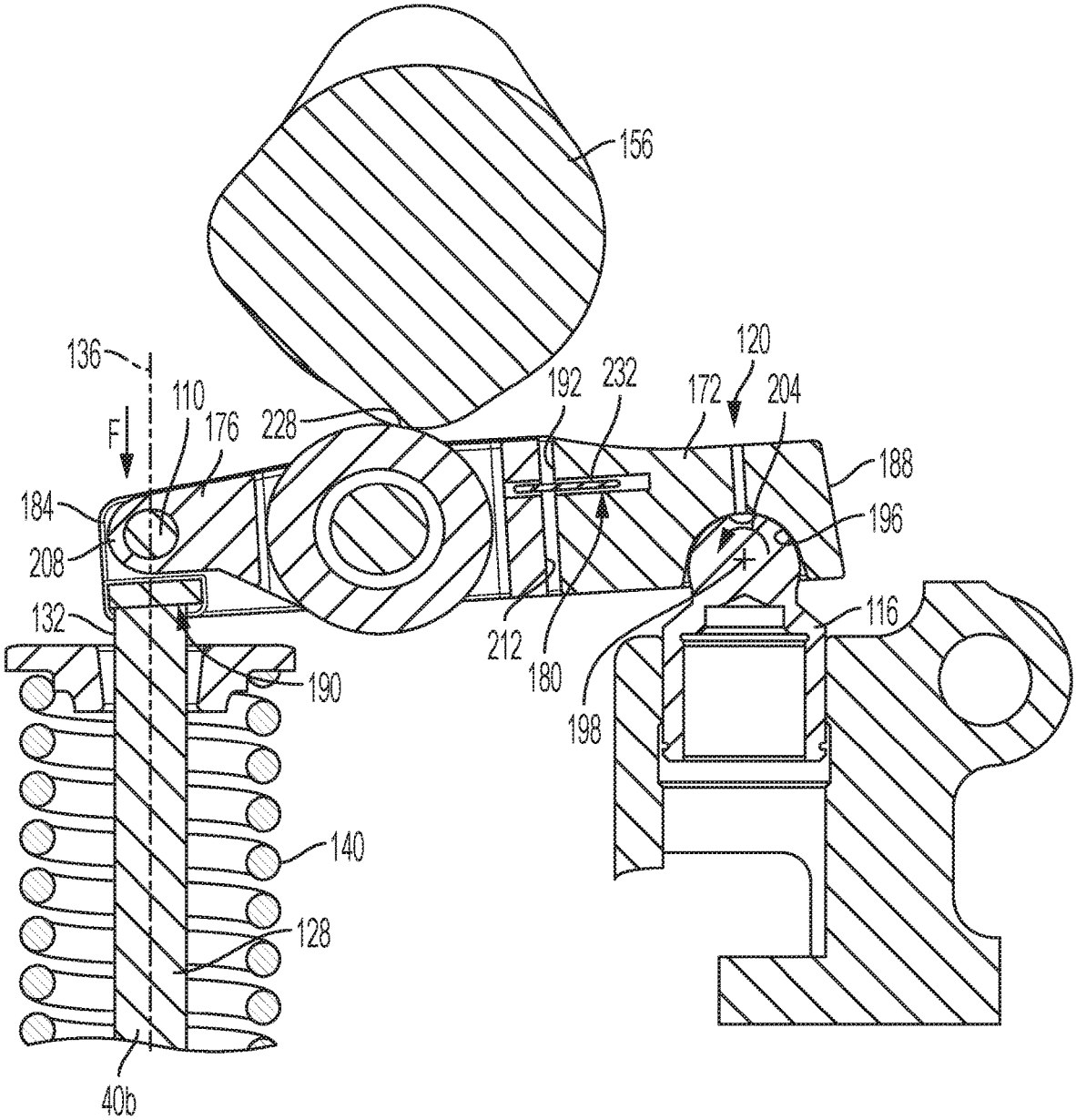
FIG. 6 is a section view taken along line 6-6 of FIG. 2 with the rocker arm assembly in a first mode of operation.
Figure 7:
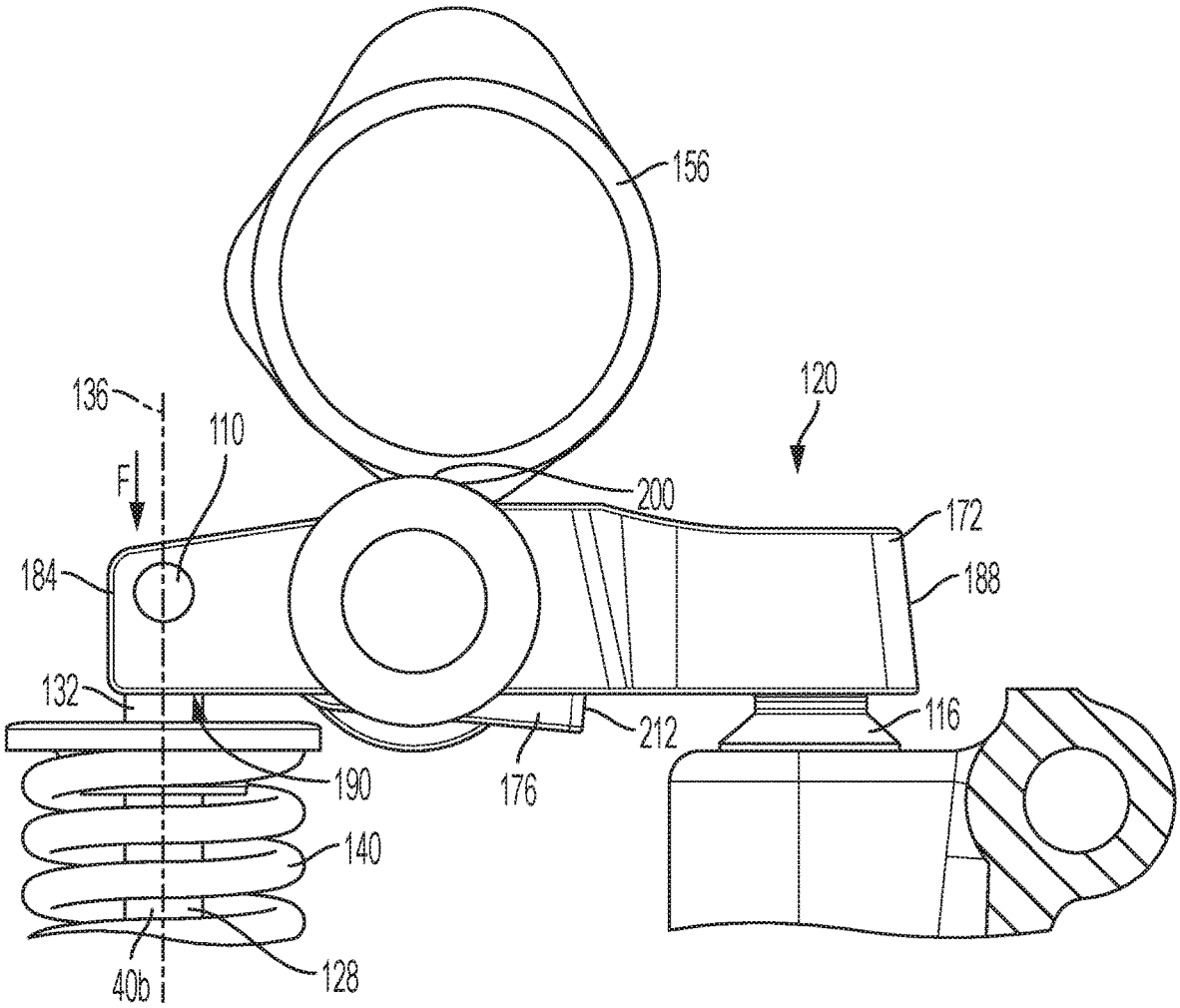
FIG. 7 is a side view of the exhaust assembly of FIG. 2 with the rocker arm in a second mode of operation.
Figure 8:
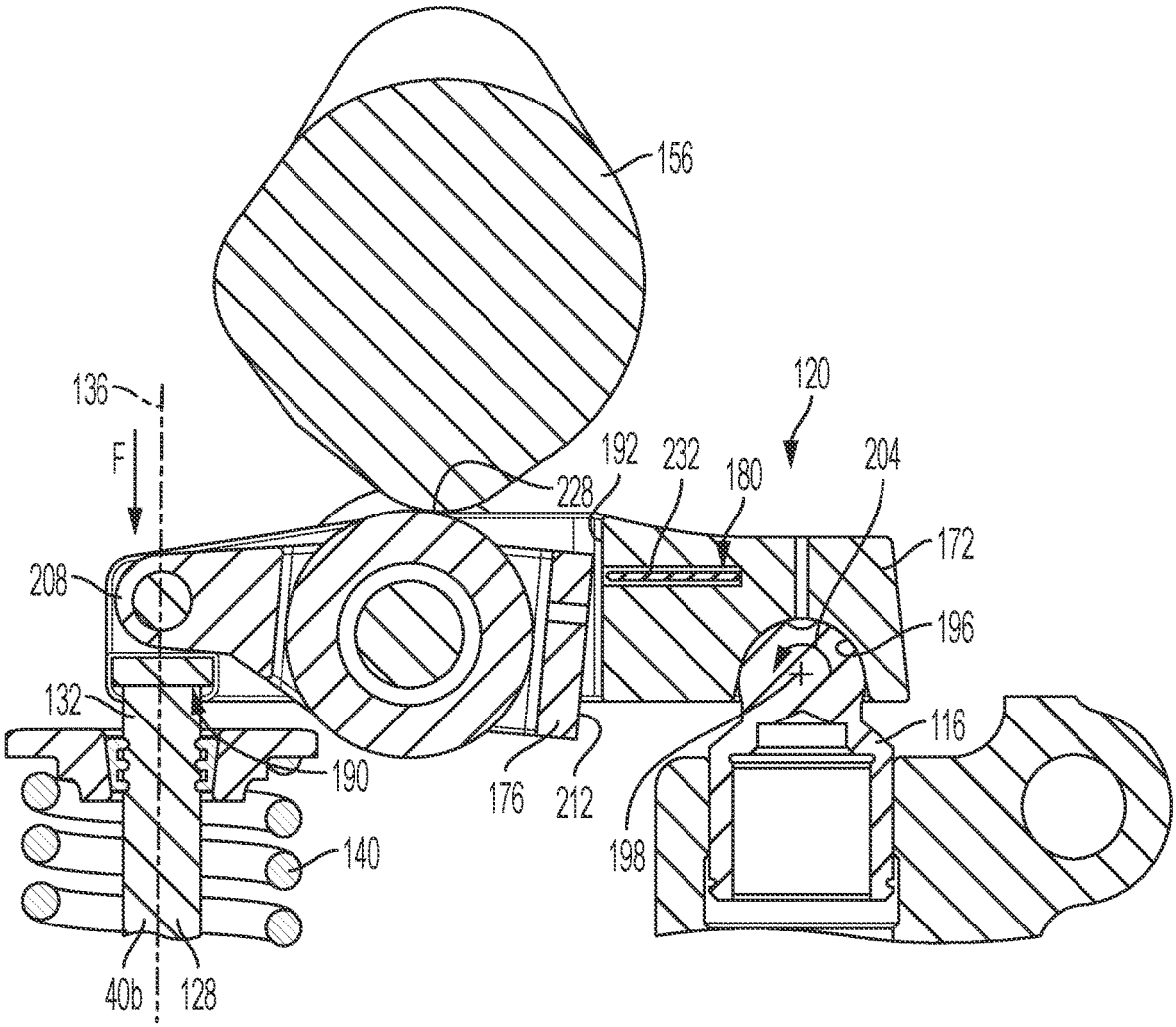
FIG. 8 is a section view taken along line 8-8 of FIG. 2 with the rocker arm in a second mode of operation.

As shown in FIGS. 6 and 8, the first end 184 of the body 172 includes a substantially flat surface or contact surface 190 configured to directly contact the distal end 132 of the valve 40*b*. The second end 188 of the body 172 defines a contact surface or recess 196 sized to at least partially receive a portion of the pivot 116 therein. During operation, the interaction between the recess 196 and the pivot 116 causes the body 172 to pivot relative to the cylinder head 22 about a pivot axis 198 that passes through the pivot 116.

The body 172 of the rocker arm assembly 120 also includes a pair of contact surfaces 200 (see FIG. 3) positioned lengthwise between the first end 184 and the second end 188 of the body 172. During use, each surface 200 is configured to selectively contact a corresponding one of the two lobe portions of the first camshaft lobe 100*a*, 100*b* and transmit any inputs to the body 172 of the rocker arm assembly 120 (see FIG. 2). More specifically, the contact surfaces 200 are positioned between the first and second ends 184, 188 to produce a Type II cam assembly.

In the illustrated implementation, the first contact surfaces 200 are located on a pair of roller bearings rotatably coupled to opposite sides of the body 172. However, in alternative implementations, the first contact surfaces 200 may be located on the body 172 itself (not shown).

Figure 5:
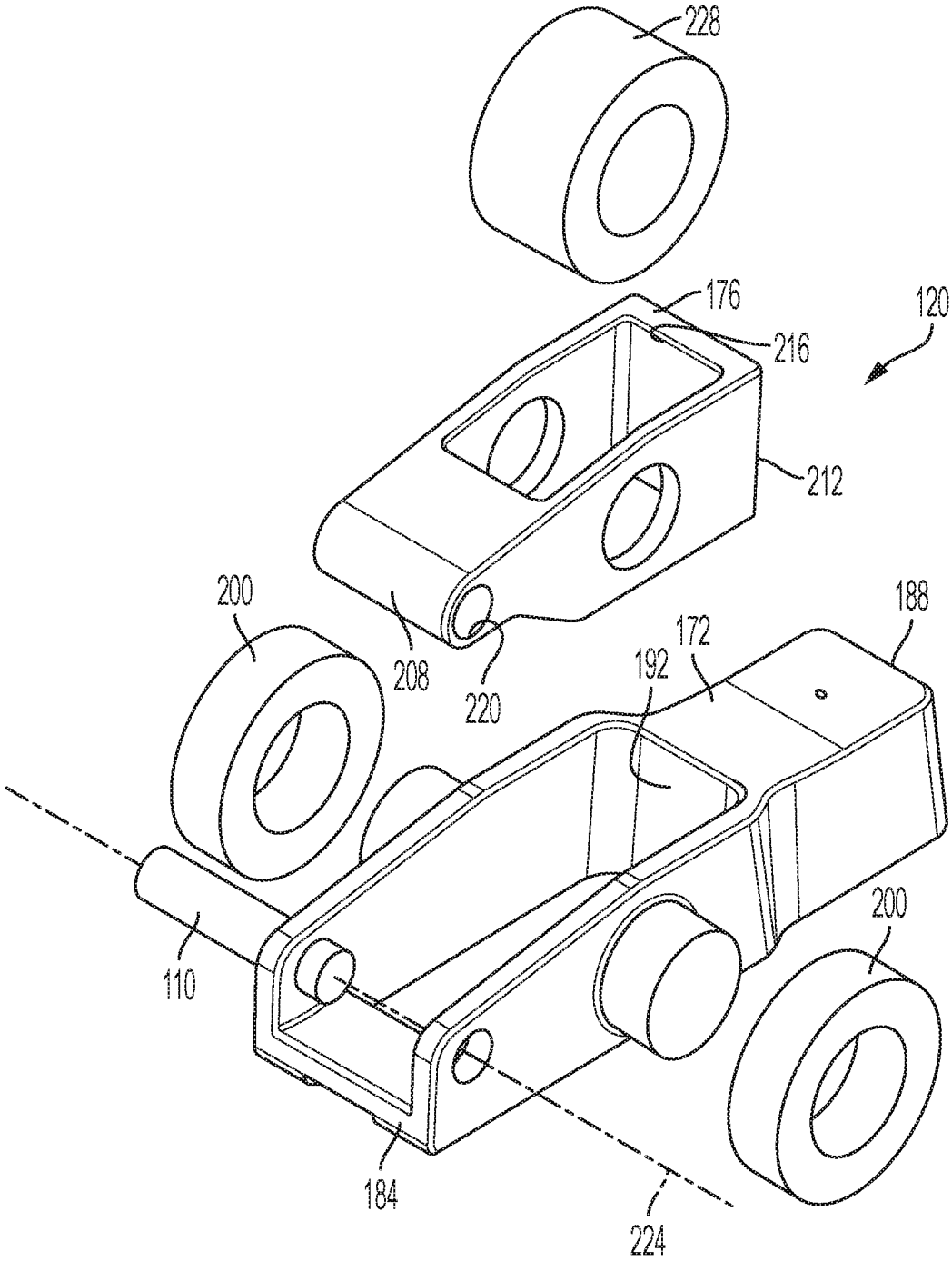
FIG. 5 is an exploded view of the rocker arm assembly of FIG. 3.

Referring also to FIG. 5, the body 172 of the rocker arm assembly 120 also includes a pivot rod 110. The pivot rod 110 is positioned at least partially within the recess 196 and oriented substantially transverse to the body. While the illustrated pivot rod 110 is shown as a separate piece, in alternative implementations the pivot rod 110 may be formed integrally therewith.

The subframe 176 of the rocker arm assembly 120 is movably (e.g., pivotably) coupled to the body 172. The subframe 176 has a first end 208 pivotably coupled to the pivot rod 110 of the body 172, a second end 212 opposite the first end 208, and defines a recess 216 therethrough. More specifically, the first end 208 of the subframe 176 defines an aperture 220 sized to receive at least a portion of the pivot rod 110 therein for pivoting about a subframe pivot axis 224. While the subframe 176 of the illustrated implementation is pivotably coupled to the body 172, in other implementations the subframe 176 may be coupled to the body 172 to produce other forms of movement such as, but not limited to, translation, and the like.

The subframe 176 of the rocker arm assembly 120 also includes a second contact surface 228 spaced a distance from the subframe pivot axis 224. When assembled, the contact surface 228 of the subframe 176 is substantially aligned with the contact surfaces 200 and positioned lengthwise between the first end 184 and the second end 188 of the body 172. During use, the second contact surface 228 is configured to selectively engage the second camshaft lobe 108 and transmit any inputs to the subframe 176. More specifically, when the subframe 176 is movable relative to the body 172, the second contact surface 228 is positioned relative to the subframe pivot axis 224 so that any lift in the second lift profile 112 causes the subframe 176 to pivot relative to the body 172 without causing the body 172 to pivot about the pivot axis 198. In contrast, when the subframe 176 is fixed relative to the body 172, the second contact surface 228 is positioned between the first and second ends 184, 188 of the body 172 to produce a Type II cam assembly. As such, any lift in the second lift profile 112 causes the body 172 and subframe 176 to pivot together as a unit about the pivot axis 198 in the first direction 204 and bias the exhaust valve 40*b* out of the closed position and toward the open position (e.g., against the biasing force of the valve spring 140).

In the illustrated implementation, the second contact surface 228 is located on a roller bearing at least partially positioned within the recess 216 of the subframe 176. However, in alternative implementations, the second contact surface 228 may be located on the subframe 176 itself (not shown).

Figure 4:
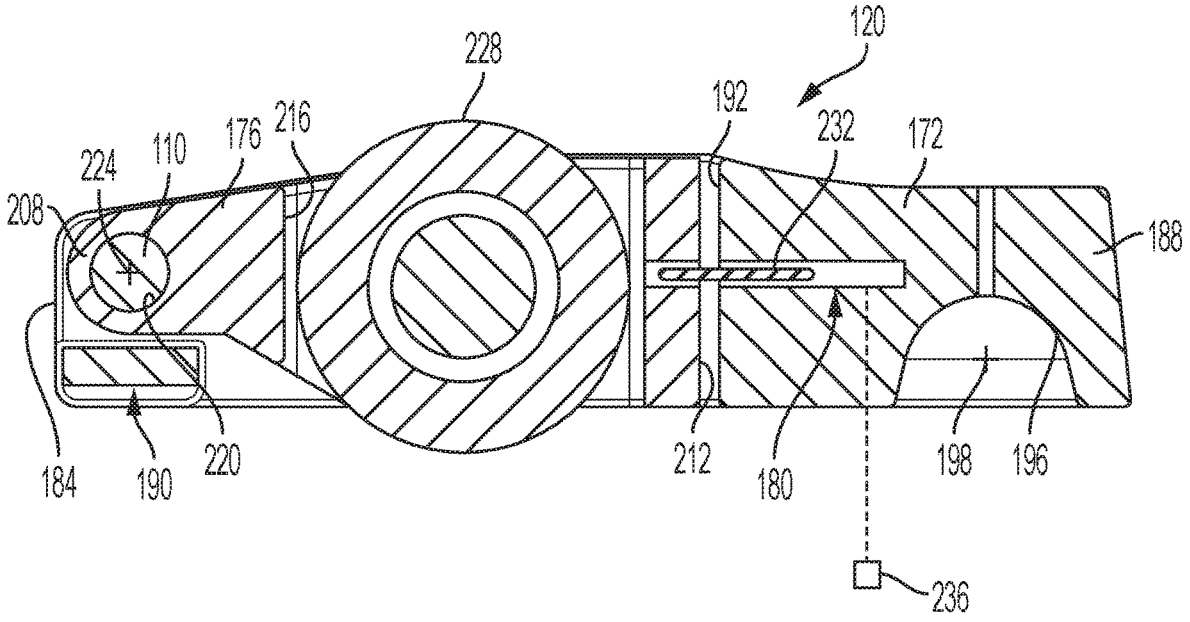
FIG. 4 is a section view taken along line 4-4 of FIG. 3.

Illustrated in FIGS. 4, 6, and 8, the locking mechanism 180 of the rocker arm assembly 120 is operatively engaged with and extends between the body 172 and the subframe 176. The locking mechanism 180 is adjustable between a locked configuration, in which the subframe 176 is fixed relative to the body 172, and an unlocked configuration, in which the subframe 176 is movable relative to the body 172. Generally speaking, the unlocked configuration corresponds with the first mode of the rocker arm assembly 120 while the locked configuration corresponds with the second mode of the rocker arm assembly 120.

In the illustrated implementation, the locking mechanism 180 includes an adjustable pin 232 that selectively extends between the body 172 and the subframe 176. More specifically, the pin 232 is movable between a first position (see FIG. 8), in which the pin 232 is positioned within only one of the body 172 or the subframe 176, and a second position (see FIG. 4), in which the pin 232 extends between and is at least partially positioned within both the body 172 and the subframe 176. As such, when the pin 232 is in the first position, the subframe 176 is free to move relative to the body 172 (e.g., the locking mechanism 180 is in the unlocked configuration). In contrast, when the pin 232 is in the second position, interference with the pin 232 locks the subframe 176 relative to the body 172 (e.g., the locking mechanism 180 is in the locked configuration).

In some implementations, the pin 232 may be moved between the first and second positions hydraulically. However, in other implementations actuators, pneumatics, magnetism, and the like may be used. Still further, while the illustrated locking mechanism 180 includes a pin 232, other forms of locking may be used such as, but not limited to, a sleeve at least partially encompassing the body 172 and subframe 176, a clutch, detents, and the like.

Figures 9A, 9B, 9C, 9D:
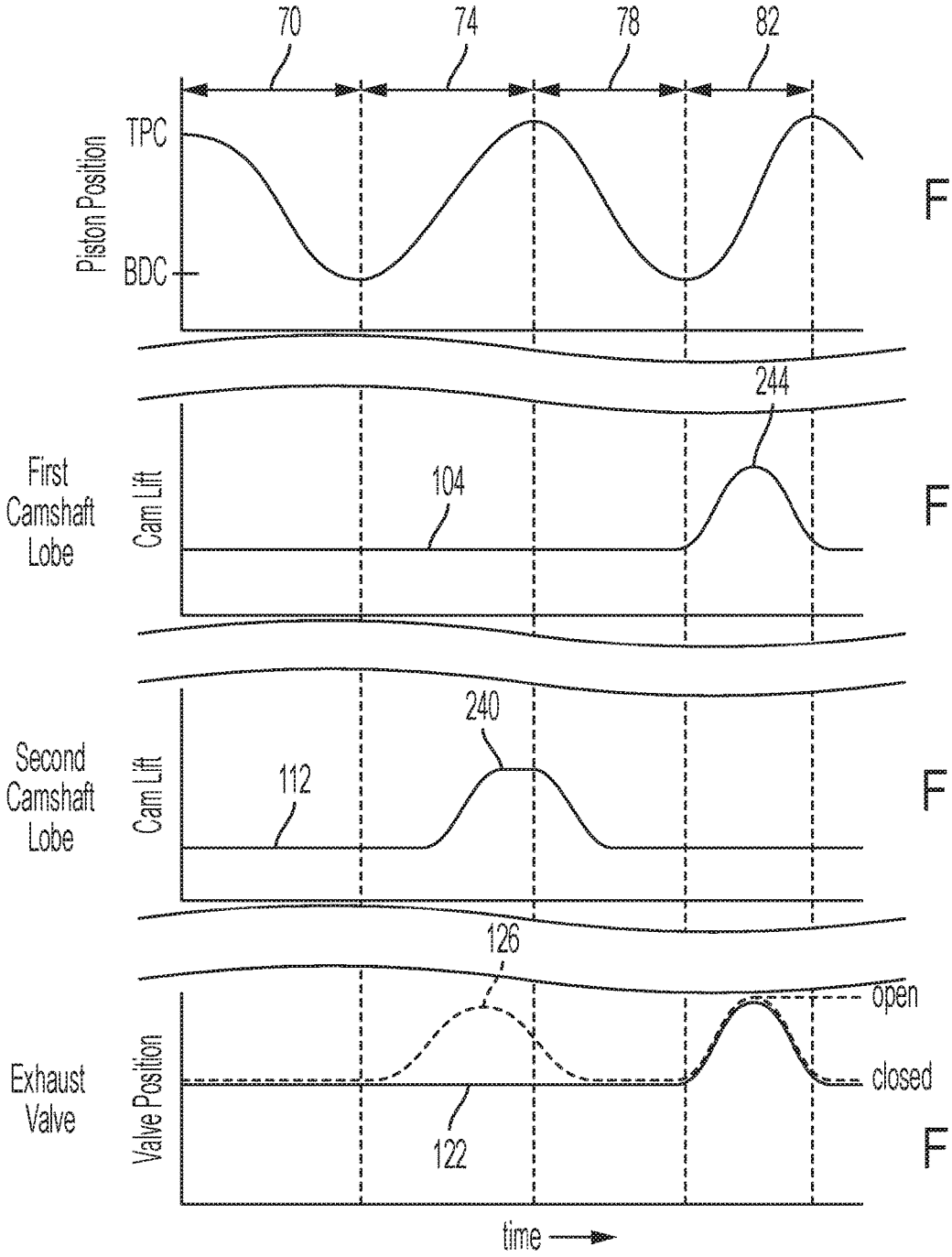
FIGS. 9A-9D are graphs showing the relative positions of the ICE, a first camshaft lob, and a second camshaft lob.

In operation, the ICE 10 begins in the positive power condition with the rocker arm assembly 120 in the first mode 122 (see FIG. 9*d*), the locking mechanism 180 in the unlocked configuration (see FIG. 8), and the piston 36 at TDC (see FIG. 9*a*). Under these conditions, the ICE 10 operates as a standard four-cycle engine (e.g., diesel engine) with only the inputs from the first camshaft lobe 100*a*, 100*b* being transmitted to the exhaust valve 40*b*. Furthermore, operation of the ICE 10 rotates the camshaft 156 relative to the cylinder head 22, causing a different region of the first and second lift profiles 104, 112 to be in contact with their corresponding contact surfaces 200, 228 at any given point in time.

To begin positive power operation, the piston 36 moves away from TDC and toward BDC, beginning the intake stroke 70. As the piston 36 travels toward BDC, the intake valve 40*a* opens to allow air into the cylinder 26 via the intake runner 50. As indicated above, the specific operation of the intake assembly 90 will not be described herein. The exhaust valve 40*b* remains closed.

After reaching BDC, the piston 36 then begins traveling back toward TDC beginning the compression stroke 74. During the compression stroke 74 the intake valve 40*a* closes, sealing the cylinder 26, and the piston 36 compresses the air within the cylinder 26. Furthermore, midway through the compression stroke 74, the second lift profile 112 of the second camshaft lobe 108 includes a lift region 240 (e.g., an increase in camshaft diameter) that rotates into contact with and acts on the second contact surface 228 of the subframe 176. Since the locking mechanism 180 is in the unlocked configuration, the subframe 176 is able to move relative to the body 172. As such, the lift 240 of the second cam profile 108 only causes the subframe 176 to pivot relative to the body 172 and is not transmitted to the exhaust valve 40*b* (see FIG. 8). In all, the exhaust valve 40*b* remains closed during the compression stroke 74 (compare FIGS. 9*a*, 9*c*, and 9*d*).

After the compression stroke 74 and when the piston 36 approaches TDC, fuel is injected into the cylinder by an injector (not shown) and ignition achieved causing the gasses in the cylinder 26 to expand. This expansion forces the piston 36 back down toward BDC in the power stroke 78 applying torque to the crank shaft 30 in the first direction of rotation 66 (e.g., driving the crank shaft 30).

Finally, after completing the expansion stroke 78, the piston 36 begins to return to TDC initiating the exhaust stroke 82. During the exhaust stroke 82, the first lift profile 104 of the first camshaft lobes 100*a*, 100*b* include a lift region 244 that rotates into contact with and acts on the first contact surfaces 200 of the body 172 causing the body 172 to rotate about the pivot axis 198 in a first direction 204 and apply a force F to the distal end 132 of the exhaust valve 40*b*. The resulting force F, biases the exhaust valve 40*b* against the exhaust valve spring 140 and causes the valve 40*b* to move from the closed position to the open position (compare FIG. 9*a*, 9*b*, and FIG. 9*d*). Once open, the piston 36 is able to force the exhaust gasses out of the cylinder 26 and into the exhaust runner 54 where they are expelled to the atmosphere.

After reaching TDC at the end of the exhaust stroke 82, the lift region 244 of the first camshaft lobe 100*a*, 100*b* ends and the exhaust valve 40*b* is biased back into the closed position via the exhaust valve spring 140. The piston 36 then initiates a second intake stroke 70 and begins the cycle anew.

To change the ICE 10 to the negative power condition (e.g., to activate the engine brake), the user enters an input into a user interface (not shown). This input, causes a controller 236 to move the pin 232 from the first position (see FIG. 8) to the second position (see FIG. 4) changing the locking mechanism 180 from the unlocked configuration to the locked configuration. By doing so, the pin 232 locks the subframe 176 relative to the body 172 causing the two elements to move together as a unit and placing the rocker arm assembly 120 in the second mode 126 (see FIG. 9*d*). While operating in the second mode 126, the rocker arm assembly 120 transmits the inputs of both the first camshaft lobe 100*a*, 100*b* and the second camshaft lobe 108 to the exhaust valve 40*b*.

To begin negative power operation, the piston 36 moves away from TDC and toward BDC, beginning the intake stroke 70. As the piston 36 travels toward BDC, the intake valve 40*a* opens to allow air into the cylinder 26 via the intake runner 50. The exhaust valve 40*b* remains closed.

After reaching BDC, the piston 36 then begins traveling back toward TDC beginning the compression stroke 74. During the compression stroke 74 the intake valve 40*a* closes, sealing the cylinder 26, and the piston 36 compresses the air within the cylinder 26. To compress the air, the piston 36 resists the rotation of the crank shaft 30, applying torque in a second direction 86 opposite the first direction of rotation 66.

Midway through the compression stroke 74, the lift region 240 of the second lift profile 112 rotates into contact with and acts on the second contact surface 228 of the subframe 176. Since the rocker arm assembly 120 is in the second mode 126, the subframe 176 moves together with the body 172, such that the lift region 240 of the second cam profile 108 rotates the body 172 about the pivot axis 198 in the first direction 204. The rotation, in turn, causes the body 120 to apply a force F to the distal end 132 of the exhaust valve 40*b* and bias the exhaust valve 40*b* against the exhaust valve spring 140 toward the open position (see FIG. 9*d*). By doing so, the compressed air within the cylinder 26 is released into the exhaust runner 54 and vented to the atmosphere. After the piston 36 reaches TDC, the lift region 240 of the second camshaft lobe 108 ends and the exhaust valve 40*b* is biased back into the closed position via the exhaust valve spring 140.

With the compressed air released, no ignition occurs and no positive power is generated to overcome the negative power used during the compression stroke 74. As such, the ICE 10 produces a negative power output overall.

Finally, after completing the expansion stroke 78, the piston 36 begins to return to TDC initiating the exhaust stroke 82. During the exhaust stroke 82, the lift region 244 of the first lift profile 104 rotates into contact with and acts on the first contact surfaces 200 of the body 172 as described above causing the body 172 to the open the exhaust valve 40*b* (compare FIG. 9*a*, 9*b*, and FIG. 9*d*). Once open, the piston 36 is then able to force any remaining gasses out of the cylinder 26 and into the exhaust runner 54.

After reaching TDC at the end of the exhaust stroke 82, the lift region 244 of the first camshaft lobe 100*a*, 100*b* ends and the exhaust valve 40*b* is biased back into the closed position via the exhaust valve spring 140. The piston 36 then initiates a second intake stroke 70 and begins the cycle anew.

To return the ICE 10 to the positive power condition, the user inputs a second command which causes the controller to return the pin 232 to the first position (see FIG. 8). This returns the locking assembly 180 to the unlocked configuration and the rocker arm assembly 120 to the first mode 122.

The illustrated valve train 14 shows only the rocker arm assembly 120 being used in the EBA 94. In other implementations, the rocker arm assembly 120 may also be implemented into both the intake assembly 90 and the EBA 94. In still other implementations, the rocker arm assembly 120 may only be implemented into the intake assembly 90. Furthermore, the valve train 14 may be retrofit onto an existing ICE 10 to produce the desired operating capabilities.

The invention claimed is:

1. An internal combustion engine defining at least one cylinder, the internal combustion engine comprising:

a first camshaft lobe;

a second camshaft lobe;

a valve in fluid communication with the at least one cylinder;

a pivot;

a follower in contact with and operatively engaging the pivot, the valve, the first camshaft lobe, and the second camshaft lobe, wherein the follower is operable in a first mode, in which the follower is configured to transmit motion between the first camshaft lobe and the valve, and a second mode, in which the follower is configured to transmit motion between the first camshaft lobe and the valve and the second camshaft lobe and the valve; and wherein the first camshaft lobe is sized and shaped to produce positive engine power, and wherein the second camshaft lobe is sized and shaped to produce negative engine power.

2. The internal combustion engine of claim 1, wherein the valve is an exhaust valve.

3. The internal combustion engine of claim 1, wherein the first camshaft lobe and the second camshaft lobe are rotatable together as a unit and located on a single camshaft.

4. The internal combustion engine of claim 1, wherein the first camshaft lobe includes a first lift, and wherein the second camshaft lobe includes a second lift different than the first lift.

5. The internal combustion engine of claim 1, wherein the follower includes a body and a subframe movable with respect to the body.

6. The internal combustion engine of claim 5, wherein the body includes a first contact surface in selective contact with the first camshaft lobe, and wherein the subframe includes a second contact surface in selective contact with the second camshaft lobe.

7. The internal combustion engine of claim 5, wherein the subframe is fixed relative to the body when operating in the second mode.

8. The internal combustion engine of claim 6, wherein the body includes a third contact surface in selective contact with the pivot, wherein the body includes a fourth contact surface in selective contact with the valve, and wherein the first contact surface is positioned between the third contact surface and the fourth contact surface.

9. The internal combustion engine of claim 8, wherein the second contact surface is positioned between the third contact surface and the fourth contact surface.

10. The internal combustion engine of claim 1, wherein the follower forms a Type II valve train.

11. The internal combustion engine of claim 1, wherein the second camshaft lobe includes a lift region during the compression stroke.

12. An internal combustion engine defining at least one cylinder, the internal combustion engine comprising:

a first camshaft lobe sized and shaped to produce a positive power condition;

a second camshaft lobe sized and shaped to produce a negative power condition;

a valve in fluid communication with the at least one cylinder;

a pivot; and a follower having a body including a first end in contact with the pivot, a second end opposite the first end in contact with the valve, and a first contact surface in contact with the first camshaft lobe, and a subframe movably coupled to the body and including a second contact surface in contact with the second camshaft lobe, wherein the follower is operable in a positive power mode, in which the subframe is movable relative to the body, and in a negative power mode, in which the subframe is fixed relative to the body.

13. The internal combustion engine of claim 12, wherein the valve is an exhaust valve.

14. The internal combustion engine of claim 12, wherein the subframe is pivotably coupled to the body.

15. The internal combustion engine of claim 12, wherein the first camshaft lobe and the second camshaft lobe are rotatable together on a single camshaft.

16. The internal combustion engine of claim 12, wherein the first contact surface includes either a first roller rotatably coupled to the body, and wherein the second contact surface includes a second roller rotatably coupled to the subframe.

17. The internal combustion engine of claim 12, wherein the first camshaft lobe has a first lift profile, and wherein the second camshaft lobe has a second lift profile different than the first lift profile.

18. The internal combustion engine of claim 12, wherein the first contact surface is in direct contact with the first camshaft lobe, and wherein the second contact surface is in direct contact with the second camshaft lobe.

19. The internal combustion engine of claim 12, wherein the first contact surface is positioned between the first end and the second end.

20. The internal combustion engine of claim 12, wherein the second camshaft lobe includes a lift region during the compression stroke.

21. A valve train assembly for use with an engine having a valve and a pivot, the valve train assembly comprising:

a camshaft having a first camshaft lobe sized and shaped to produce a positive power condition of the engine and a second camshaft lobe sized and shaped to produce a negative power condition of the engine;

a follower having a body including a first end in contact with the pivot, a second end opposite the first end in contact with the valve, and a first contact surface in contact with the first camshaft lobe, and a subframe movably coupled to the body and including a second contact surface in contact with the second camshaft lobe, wherein the follower is operable in a positive power mode, in which the subframe is movable relative to the body, and in a negative power mode, in which the subframe is fixed relative to the body.

22. The valve train assembly of claim 21, wherein the subframe is pivotable relative to the body.

23. The valve train assembly of claim 21, wherein the second camshaft lobe includes a lift region during the compression stroke.

* * * * *